US012778216B2

(12) United States Patent
Xia

(10) Patent No.: US 12,778,216 B2
(45) Date of Patent: Nov. 3, 2026

(54) BRASSIERE CONFIGURED FOR GATHERING MAMMA ACCESSORIA

(71) Applicant: Wei Xia, Dafeng (CN)

(72) Inventor: Wei Xia, Dafeng (CN)

( * ) Notice: Subject to any disclaimer, the term of this patent is extended or adjusted under 35 U.S.C. 154(b) by 0 days.

(21) Appl. No.: 19/362,378

(22) Filed: Oct. 18, 2025

(65) Prior Publication Data

US 2026/0107992 A1 Apr. 23, 2026

(30) Foreign Application Priority Data

Oct. 23, 2024 (CN) ..... 202422564276.4

(51) Int. Cl.
*A41C 3/10* (2006.01)

(52) U.S. Cl.
CPC ..... *A41C 3/10* (2013.01)

(58) Field of Classification Search
CPC ..... A41C 3/10; A41C 3/142; A41C 3/122
USPC ..... 450/54
See application file for complete search history.

(56) References Cited

U.S. PATENT DOCUMENTS

| | | | | |
|---|---|---|---|---|
| 7,458,877 | B2 * | 12/2008 | Yu | A41C 5/005 450/39 |
| 2004/0029485 | A1 * | 2/2004 | Pagliarulo | A41C 3/0007 450/1 |
| 2016/0044970 | A1 * | 2/2016 | Yuasa | A41C 3/0021 450/52 |
| 2016/0044971 | A1 * | 2/2016 | Randall | A41C 3/142 450/39 |
| 2019/0261700 | A1 * | 8/2019 | Hubbard | A41C 3/06 |
| 2019/0328051 | A1 * | 10/2019 | Fildan | A41C 3/128 |
| 2022/0346467 | A1 * | 11/2022 | Chou | A41C 3/122 |

* cited by examiner

*Primary Examiner* — Timothy K Trieu
(74) *Attorney, Agent, or Firm* — SciNova; Jingfeng Song

(57) ABSTRACT

A brassiere configured for gathering mamma accessoria includes a brassiere main body. The brassiere main body includes a first pressure portion, a second pressure portion, and a third pressure portion. The brassiere main body further includes two cups, two side wings, and two back wings. Outer side edges of the two cups are connected to the side wings. The two side wings are connected to the back wings. The first pressure portion is arranged at a junction between the side wing and the back wing. The second pressure portion is arranged on the side wing. The third pressure portion is arranged on the cup and is arranged close to the side wing.

18 Claims, 11 Drawing Sheets

BRASSIERE CONFIGURED FOR GATHERING MAMMA ACCESSORIA

CROSS-REFERENCE TO RELATED APPLICATIONS

The application claims priority of Chinese patent application CN2024225642764, filed on Oct. 23, 2024, disclosure of which is incorporated herein by reference in its entirety.

BACKGROUND

The brassiere serves as intimate apparel for daily wear by women, designed to support and protect the female breasts. Presently, different brassieres with numerous structural designs and styles exist on the market, including push-up shaping brassieres, lightweight comfort brassieres, and seamless skin-adhering brassieres.

Based on an analysis of existing brassieres on the market, most products primarily focus on comfort, but often neglect consumers' demand for a flattering wearing effect. Research and analysis indicate that consumers seek products that can achieve the effect of gathering mamma accessoria (accessory breast) while maintaining comfort. Meanwhile, these brassieres feature a certain lifting function, so as to beautify the breast shape. Currently, the structural techniques used for achieving mamma accessoria gathering function in existing brassieres are relatively single. Most of existing brassieres merely design flexible support bones on the side wings. This design can push the breast inward, thereby serving to gather the breast. However, due to the small force-bearing areas of the flexible support bones, this causes a certain degree of pressure on the wearers. Furthermore, the mamma accessoria tends to escape from the cup. Therefore, these products fail to achieve the combined effects of comfort, mamma accessoria gathering, and breast shaping. Additionally, as most brassieres on the market are designed with comfort as a leading principle, the brassieres frequently adopt a wire-free support design at the bottom of the cup. Although this design enhances wearing comfort to some extent, it also presents a significant drawback. The lack of adequate supporting force may lead to breast sagging. Consequently, when wearing such brassieres, the breast often appears less uplifted, and sagging phenomenon may even occur. This not only adversely affects the aesthetic contour of the female body, but may also have a negative impact on the breast health.

SUMMARY

In order to overcome the shortcomings of the existing technology, the technical solution adopted by the present disclosure is as follows.

The present disclosure provides a brassiere configured for gathering mamma accessoria. The brassiere includes a brassiere main body. The brassiere main body includes a first pressure portion, a second pressure portion, and a third pressure portion. The brassiere main body further includes a cup, a side wing, and a back wing. An outer side edge of the cup is connected to a first side of the side wing, and a second side of the side wing is connected to the back wing. The first pressure portion is arranged at a junction between the side wing and the back wing. The junction is positioned on the back wing. The first pressure portion is configured for providing pressure to a lateral side of the brassiere main body. A portion of the second pressure portion is arranged on the side wing, and is configured for providing pressure to the lateral side of the brassiere main body. The third pressure portion is arranged on the cup and close to the side wing. The third pressure portion is configured for providing pressure to the cup.

Beneficial effects of the present disclosure are as follows. The present disclosure provides a brassiere configured for gathering mamma accessoria. Three regions with different pressure are arranged on the brassiere to realize pressure-dividing mamma accessoria gathering. The first pressure portion provides the greatest pressure. The first pressure portion serves to push the mamma accessoria into the brassiere cup and create a barrier at that area to prevent the mamma accessoria from escaping. The pressure provided by the second pressure portion is smaller than that provided by the first pressure portion. The second pressure portion is capable of generating a lateral pushing force to ensure that the mamma accessoria is within the cup. The third pressure portion provides the smallest pressure, and can be designed as a thin layer of shaping mesh to wrap the mamma accessoria within the cup. This design enables the brassiere to effectively gather the mamma accessoria. Furthermore, the design of gradual pressure distribution reduces pressure on the breast, thereby significantly enhancing wearing comfort. Moreover, an inelastic flexible padding sheet is arranged on a side surface of a flexible bone close to the skin. The inelastic flexible padding sheet is wider and longer than the flexible bone. Therefore, the inelastic flexible padding sheet is capable of helping the flexible bone to distribute the pressure. Compared with the direct pressure from the flexible bone, the inelastic flexible padding sheet provides higher comfort when conforming to the skin, which further improves wearing comfort for users.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
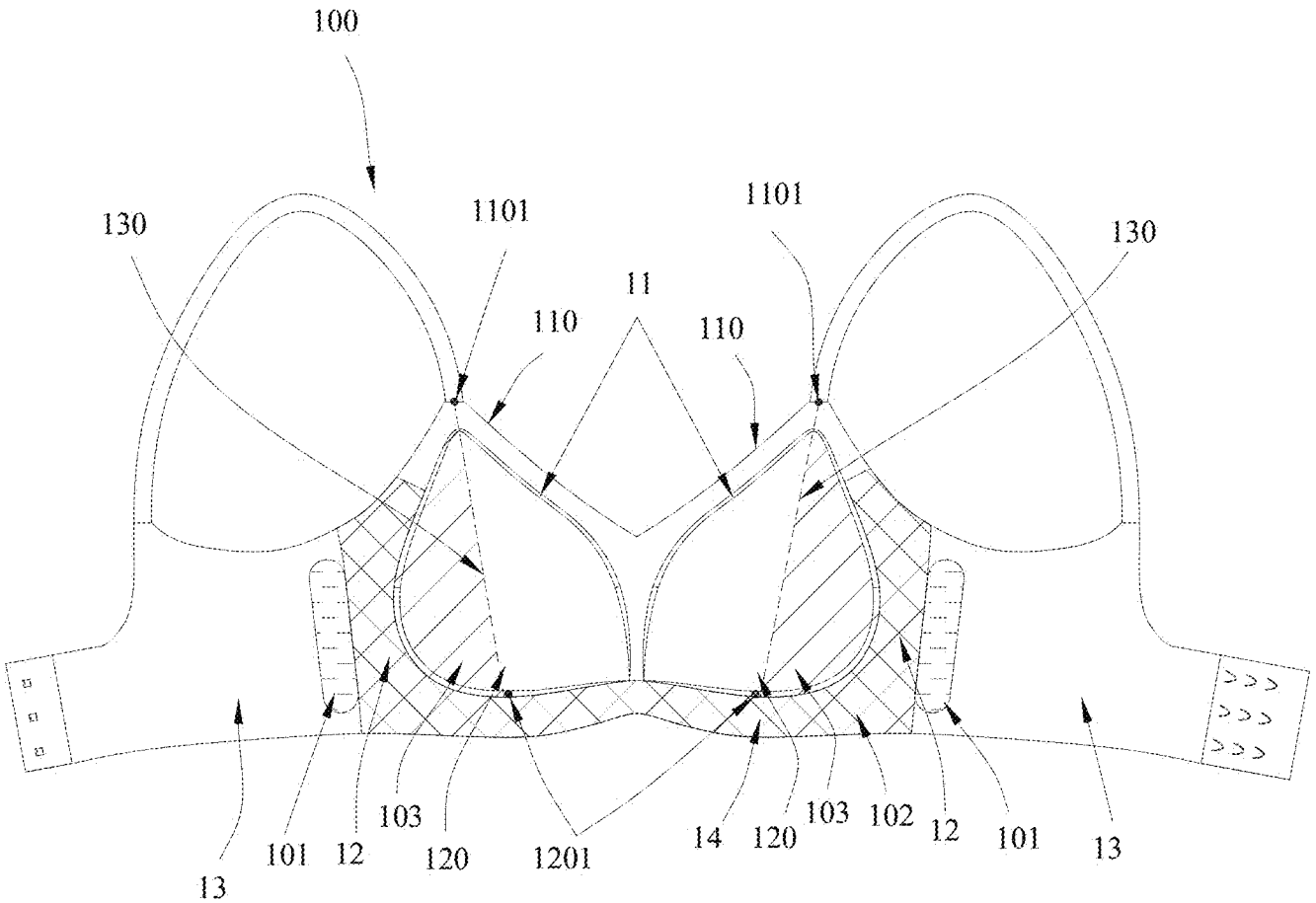
FIG. 1 is a front view of a brassiere according to a first embodiment of the disclosure.
Figure 2:
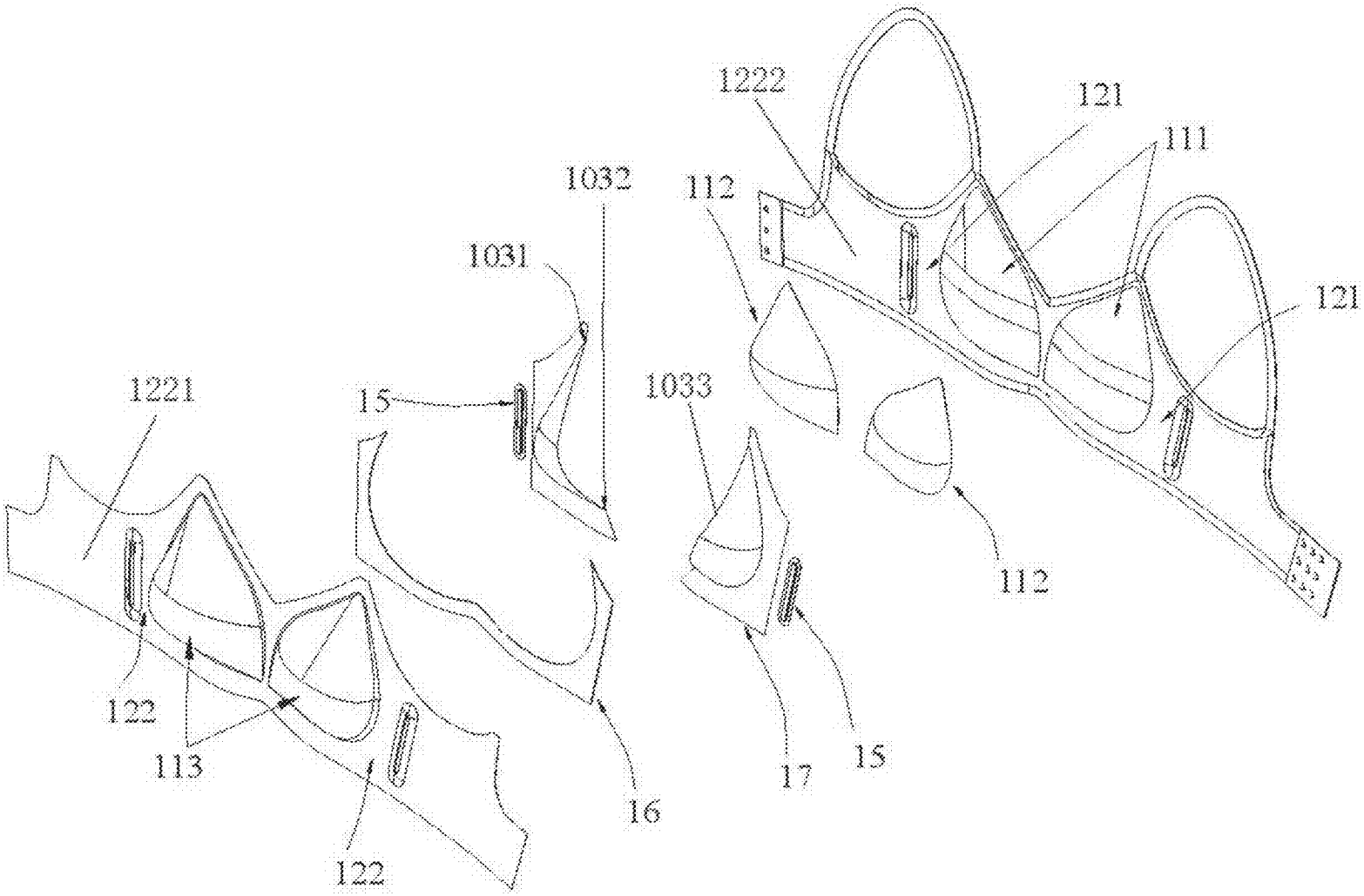
FIG. 2 is an exploded view of the brassiere in the first embodiment of the disclosure.
Figure 3:
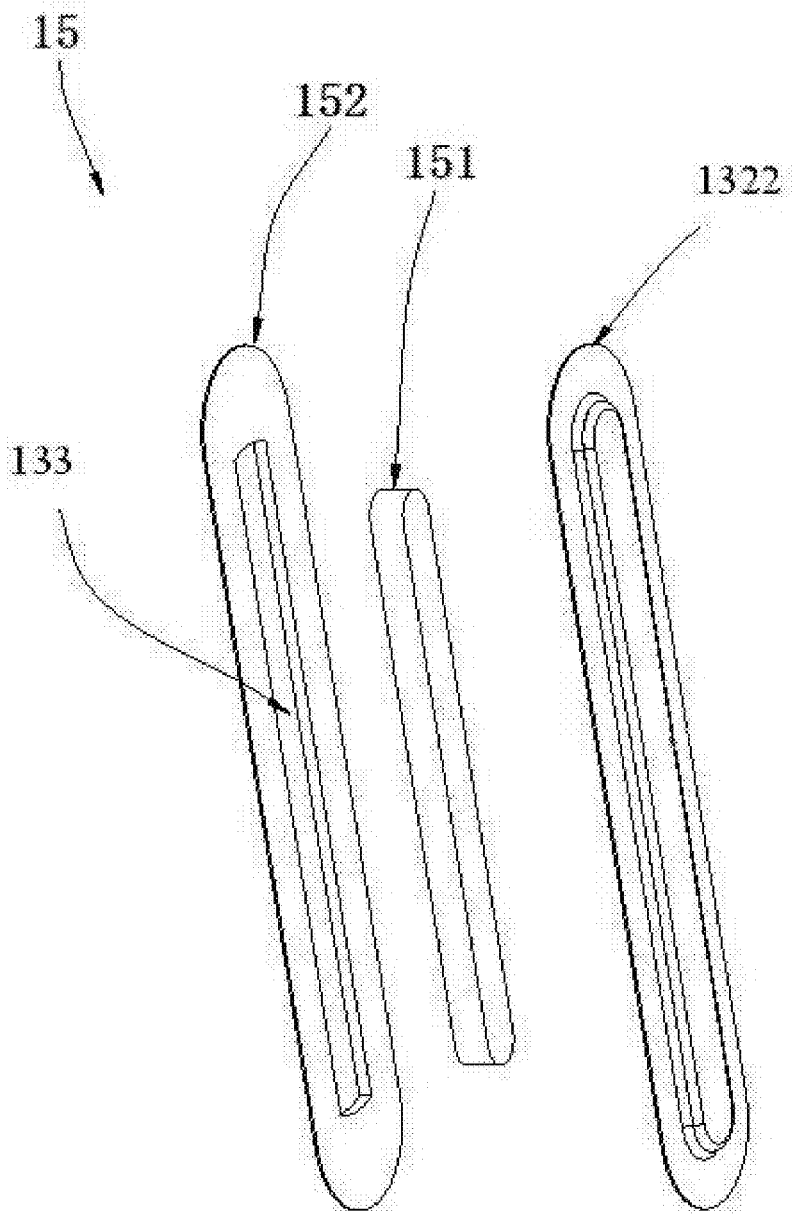
FIG. 3 is an exploded view of a support bone in the first embodiment of the disclosure.
Figure 4:
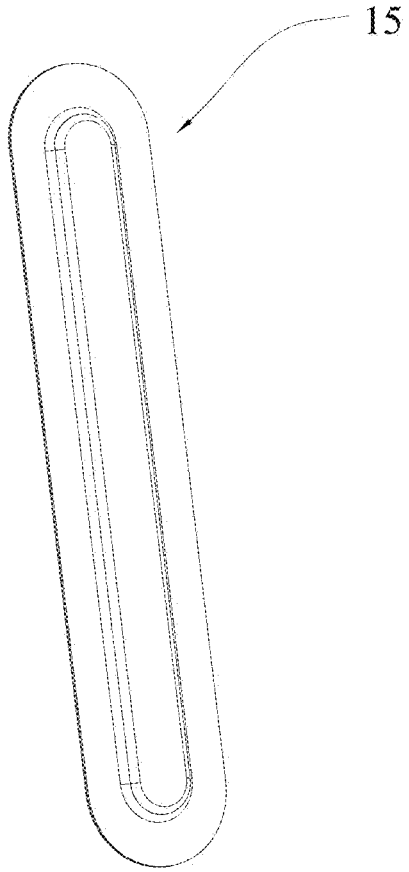
FIG. 4 is a perspective view of the support bone in the first embodiment of the disclosure.
Figure 5:
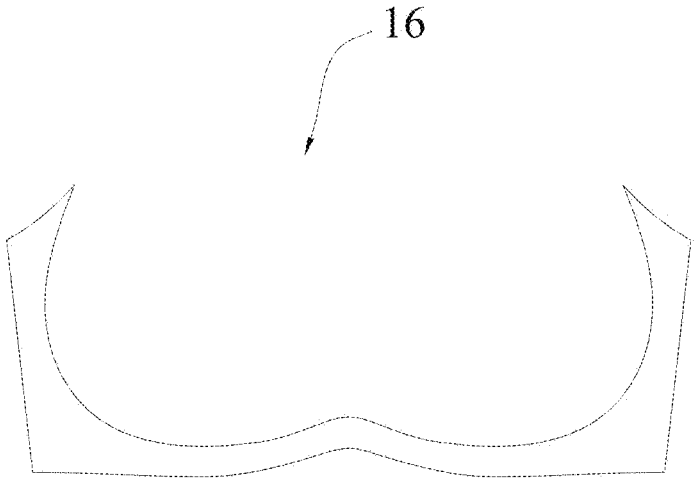
FIG. 5 is a perspective view of a first pressure plate in the first embodiment of the disclosure.
Figure 6:
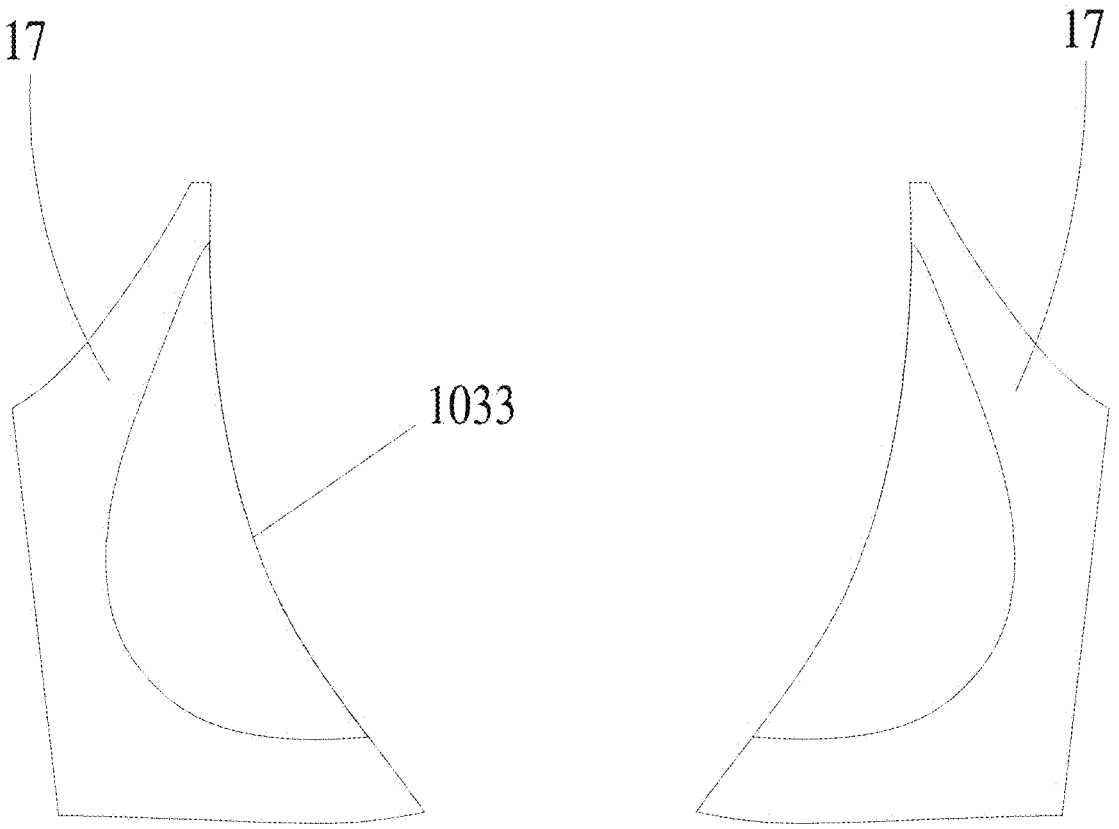
FIG. 6 is a perspective view of a second pressure plate in the first embodiment of the disclosure.
Figure 7:
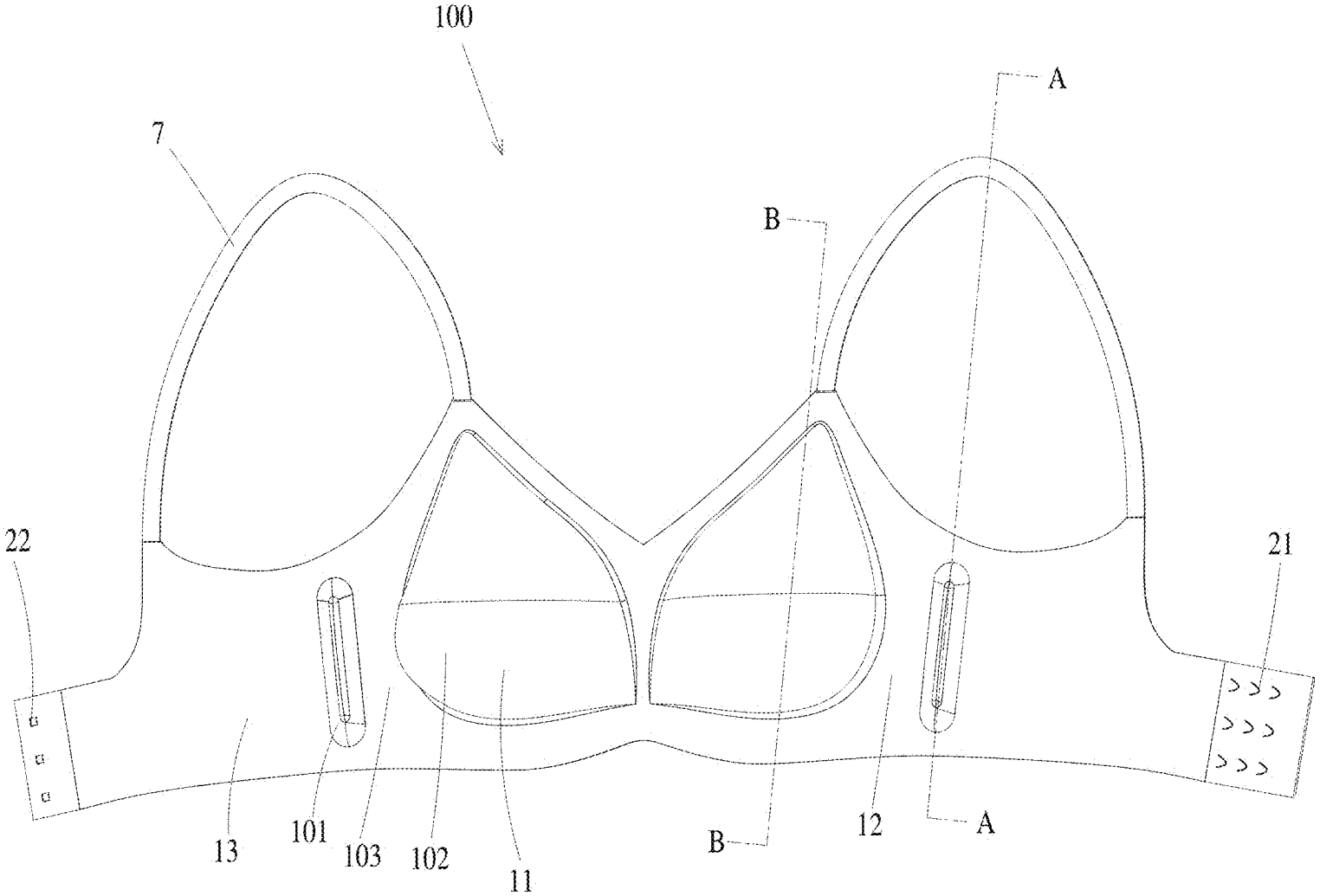
FIG. 7 is a perspective view of the brassiere in the first embodiment of the disclosure.
Figure 8:
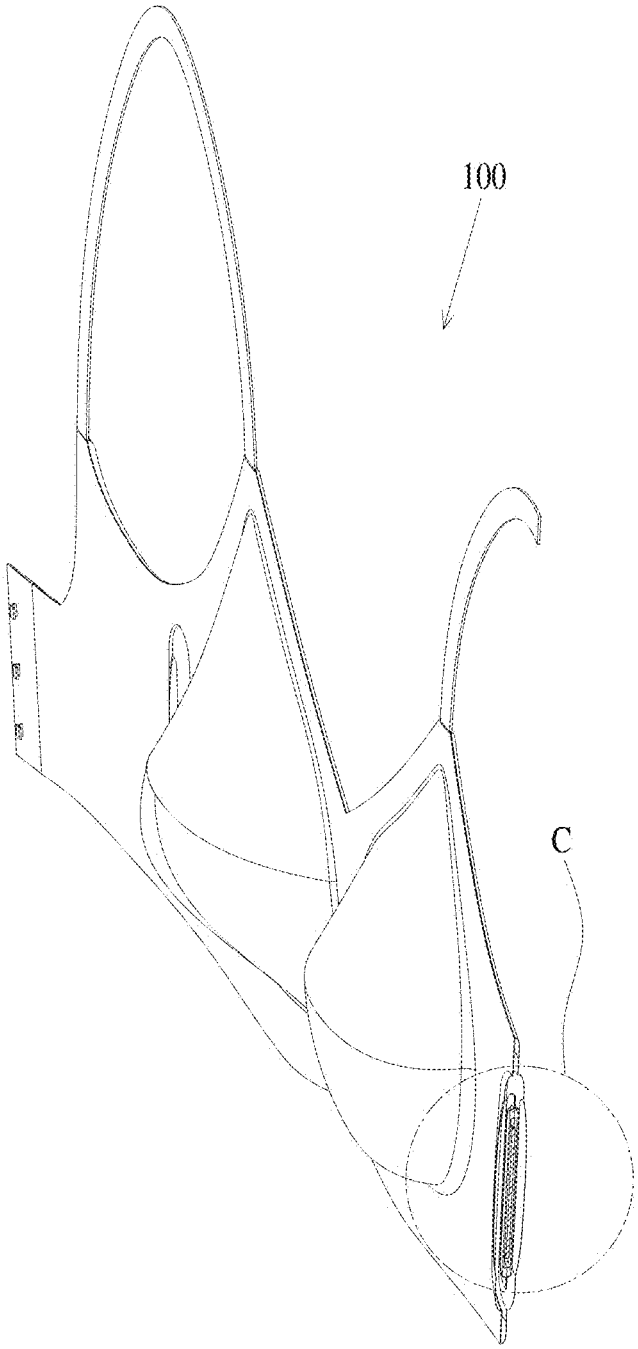
FIG. 8 is a sectional view taken along line A-A in the FIG. 7.
Figure 9:
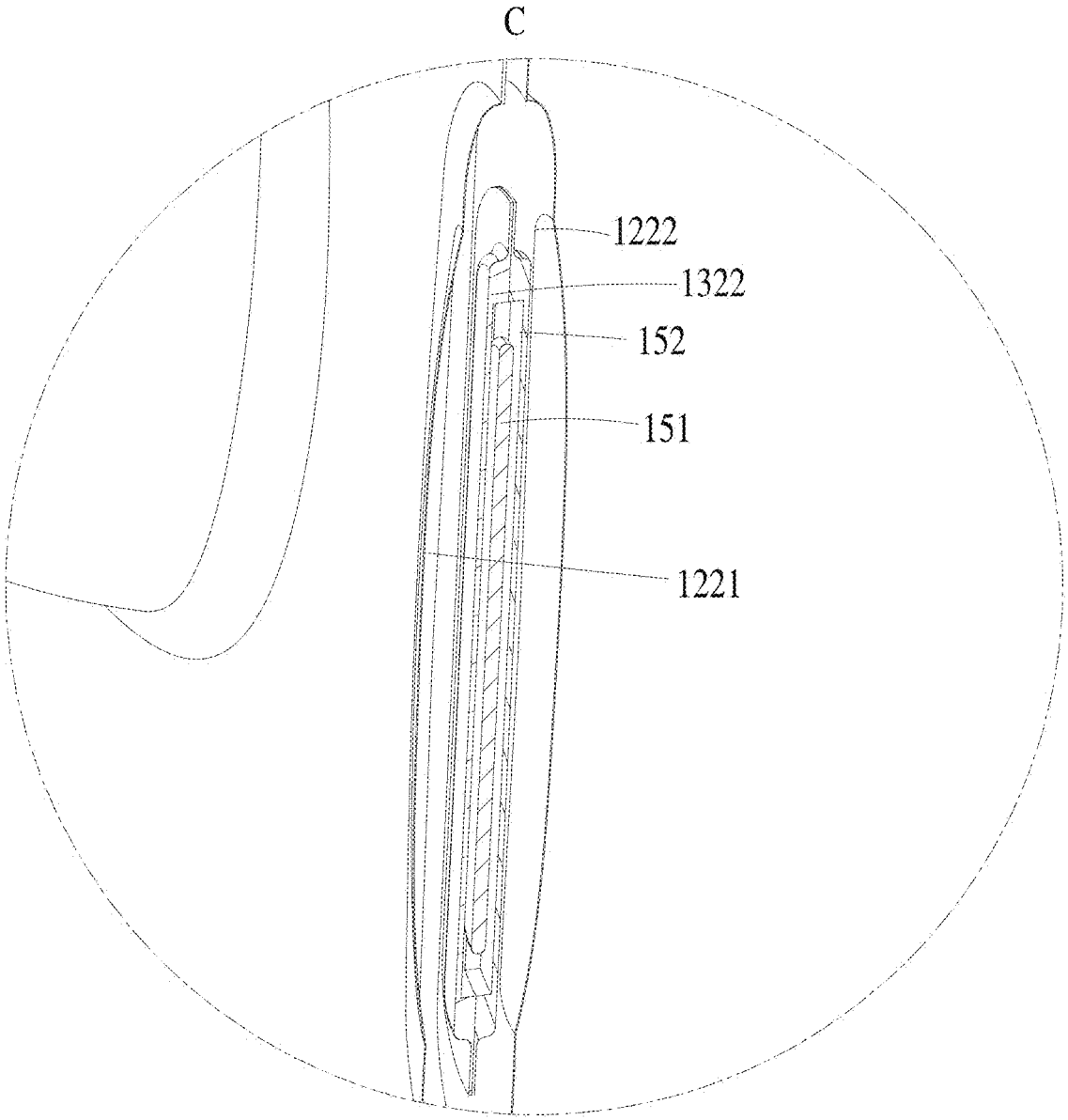
FIG. 9 is an enlarged view of area C in FIG. 8.
Figure 10:
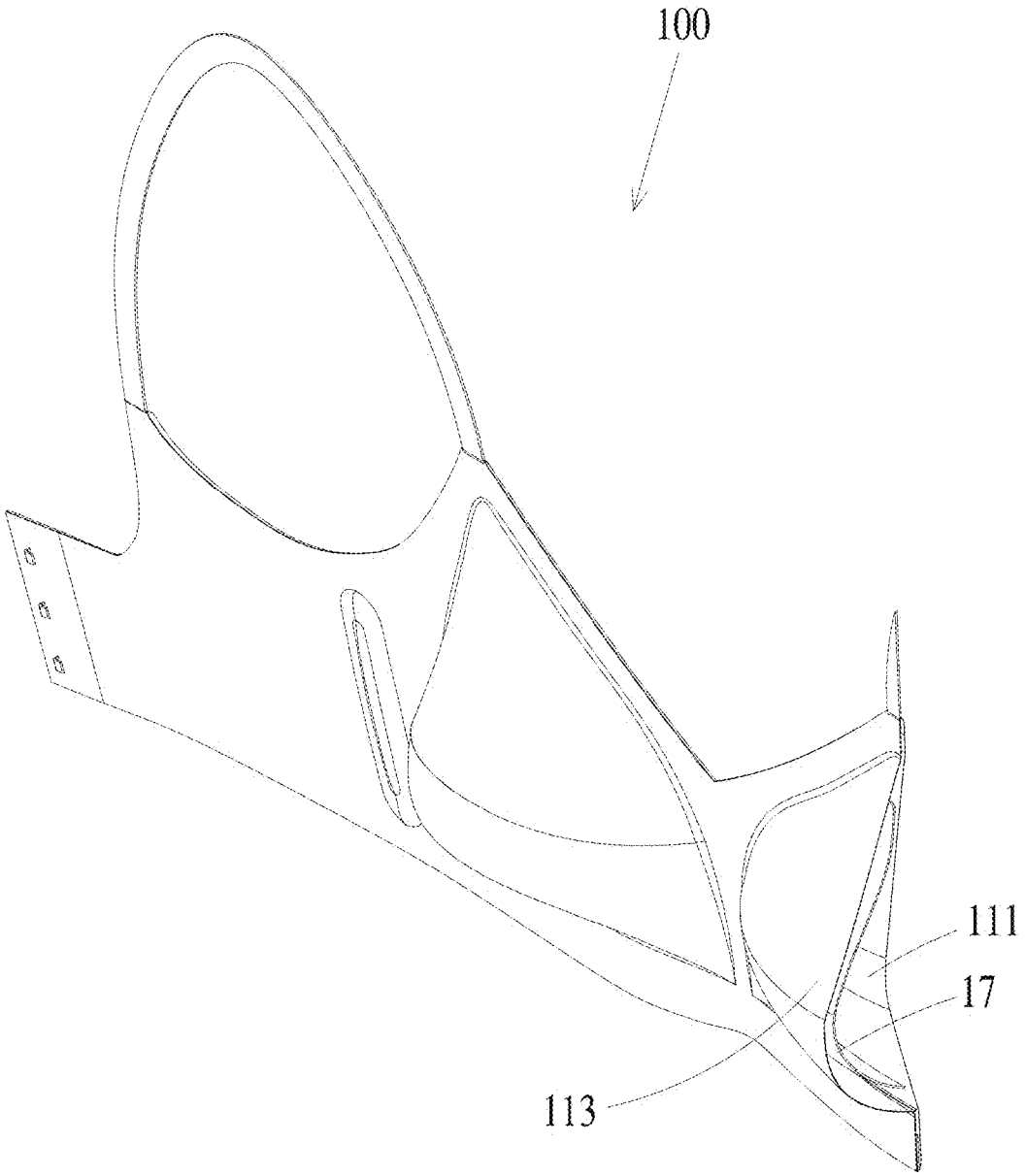
FIG. 10 is a sectional view taken along line B-B in the FIG. 7.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

First Embodiment

Referring to FIG. 1-FIG. 10, the present disclosure provides a brassiere (i.e., a bra) configured for gathering mamma accessoria. The brassiere includes a brassiere main body 100. The brassiere main body 100 includes a first pressure portion 101, a second pressure portion 102, and a third pressure portion 103. In FIG. 1 of the specification, an area with dotted-and-dashed line pattern is the first pressure portion 101, a grid pattern area is the second pressure portion 102, and a hatched area is the third pressure portion 103. The brassiere main body 100 includes two cups 11, two side wings 12, and two back wings 13. Outer side edges of the two cups 11 are connected to the side wings 12. The two side wings 12 are connected to the back wings 13. The first pressure portion 101 is arranged at a junction between the side wing 12 and the back wing 13. A portion of the second pressure portion 102 is arranged on the side wing 12. The third pressure portion 103 is arranged on the cup 11 and is arranged close to the side wing 12. That is, three regions with different pressure are arranged on the brassiere main body 100 to realize pressure-dividing mamma accessoria gathering and lifting. The first pressure portion 101 provides the greatest pressure. The first pressure portion 101 serves to push the mamma accessoria into the cup 11 and create a barrier at that area to prevent the mamma accessoria from escaping. The pressure provided by the second pressure portion 102 is smaller than that provided by the first pressure portion 101. The second pressure portion 102 is capable of generating a lateral pushing force to ensure that the mamma accessoria is within the cup 11. The third pressure portion 103 provides the smallest pressure and can be designed as a thin layer of inelastic mesh, so as to make the breast and mamma accessoria wrapped in the cup oblique inward, thereby improving the gathering and lifting effect. This design enables the brassiere to effectively gather the mamma accessoria. Furthermore, the design of gradual pressure distribution reduces pressure on the breast, thereby significantly enhancing wearing comfort. After wearing this brassiere, the third pressure portion 103 is configured for making the breast and mamma accessoria wrapped in the cup 11 oblique inward, thereby improving the gathering and lifting effect. This significantly improves wearing comfort for users and enhances shaping effect.

In this embodiment, the brassiere further includes a lower band 14. The lower band 14 is connected under the two cups 11 and is connected to the two side wings 12. A portion of the second pressure portion 102 is also arranged on the lower band 14, so as to provide better support for the breast. The second pressure portions 102 on the side wings 12 are integrally connected, thereby further improving breast tightening and support.

In this embodiment, the second pressure portion 102 is configured for fully covering the side wing 12 longitudinally along a boundary of the first pressure portion 101 close to the side wing 12, and a portion of the second pressure portion 102 is arranged on the side wing 12. In addition, the second pressure portion 102 is configured for fully covering the lower band 14, so as to enable the second pressure portion 102 to provide pressure to a lateral side and a lower portion of the brassiere main body 100. That is, the second pressure portion does not entirely cover the entire side wing. Instead, the second pressure portion is configured for longitudinally covering the side wing with inner boundaries of the first pressure portion serving as demarcation lines. Through such a uniform modular configuration, the applied pressure is modular and integral rather than dispersed, thereby enhancing wearing comfort for users and providing better support and tightening for the mamma accessoria. If the second pressure portion 102 is only arranged on an area of the lower band 14 close to the breast, users may feel uncomfortable at the lower band 14 due to different pressure distribution, causing users to feel excessive tightness. Conversely, if the second pressure portion 102 is only arranged on an area of the lower band 14 distal from the breast, the supporting force may be insufficient, still resulting in a sensation of tightness and discomfort for users. Moreover, the second pressure portion is configured for longitudinally covering the side wing. This primarily serves to better tighten the mamma accessoria and reduce discomfort caused by uneven pressure distribution.

In this embodiment, the second pressure portion 102 on the lower band 14 and the second pressure portion 102 on the side wing 12 are connected to form a W-shaped configuration. This W-shaped configuration corresponds to the contour of the lower breast region, so as to enable the second pressure portion 102 to provide pressure and supporting force to both the lateral side and the lower portion of the brassiere main body 100. Therefore, when worn, the brassiere provides an enhanced lifting effect to the breast. Furthermore, the cooperation between the second pressure portion 102 and the third pressure portion 103 contributes to a shaping and lifting effect for the breast.

In this embodiment, the brassiere main body 100 further includes the lower band 14. The lower band 14 is arranged below the cup 11 and is connected to the cup 11. The lower band 14 is connected to the side wing 12. One side of the third pressure portion 103 is at least connected to side edges of the cup 11 close to the side wing 12 and the lower band 14, so as to enable the third pressure portion 103 to provide pressure to the cup 11 both at a lateral side and a lower portion. Through arrangement of the above structure, the third pressure portion 103 is capable of providing pressure on the lateral side and the lower portion of the cup 11. When users wearing the brassiere, the third pressure portion 103 is capable of providing supporting force on the lateral side and the lower portion of the breast, so as to prevent breast sagging and better shape the breast.

In this embodiment, an inner edge 1033 of the third pressure portion 103 close to a central area of the cup 11 is in a released state, and the inner edge 1033 is arc-shaped, so as to enable the inner edge 1033 to match a shape of the cup 11. Therefore, the third pressure portion 103 is configured for providing no pressure to the central area of the cup 11. Through arrangement of the above structure, when users wearing the brassiere, the central area of the cup 11 is subjected to no pressure. This achieves a better breast shaping effect, thereby further shaping the breast.

In this embodiment, the third pressure portion 103 is arranged in a crescent shape. A top end of the third pressure portion 103 is arranged at a vertex 1101 of a front panel edge of the cup 11, and a bottom end of the third pressure portion 103 is arranged close to a lowest point 1201 of a lower support 120 of the cup 11. A boundary of the third pressure portion 103 distal from the side wing 12 is arranged close to a central line 130 of the cup 11. This structure realizes the effect of lifting the breast upwards and inwards. When the mamma accessoria is gathered in the cup 11, the increased breast volume may lead to breast sagging. Therefore, the above structure can better lift users' breast shape.

In this embodiment, the first pressure portion 101, the second pressure portion 102, and the third pressure portion 103 are made of different material, so as to enable the first pressure portion 101, the second pressure portion 102, and the third pressure portion 103 to provide different pressure. Through arrangement of the above structure, the materials used in the first pressure portion 101, the second pressure portion 102, and the third pressure portion 103 are different, thereby enabling the first pressure portion 101, the second pressure portion 102, and the third pressure portion 103 to provide different pressure, so as to provide varying shaping effects for users' breasts at different sectional positions. Different divided pressure can better shape users' breasts.

In this embodiment, the brassiere main body 100 further includes a support bone 15, a first pressure plate 16, and a second pressure plate 17. The support bone 15 is arranged on the first pressure portion 101. The first pressure plate 16 is arranged on the second pressure portion 102, and the second pressure plate 17 is arranged on the third pressure portion 103. The pressure of the support bone 15 on the skin is greater than that of the first pressure plate 16, and the pressure of the first pressure plate 16 on the skin is greater than that of the second pressure plate 17. The force area of the support bone 15 is small, which can better gather the mamma accessoria. The plate-shaped configuration of the first pressure plate 16 and the second pressure plate 17 can better wrap the mamma accessoria. Compared with elastic straps, the pressure plates have better shaping function. In this embodiment, the first pressure plate 16 has a certain thickness and is made of inelastic flexible material, while the second pressure plate 17 is made of inelastic mesh material. The use of different materials simplifies manufacturing, since using the same material would require to either reduce the thickness of the thicker material or thicken the thinner material, thereby increasing additional production steps. Furthermore, both the first pressure plate 16 and the second pressure plate 17 are made of inelastic material, so as to provide better shaping effect.

In this embodiment, the cup 11 includes a first skin-contact fabric layer 111, a cup pad 112, and a first outer fabric layer 113. The cup pad 112 is arranged between the first skin-contact fabric layer 111 and the first outer fabric layer 113. The second pressure plate 17 is connected to the first outer fabric layer 113. The second pressure plate 17 is positioned between the cup pad 112 and the first outer fabric layer 113. If the second pressure plate 17 is made of inelastic mesh material, and the inelastic mesh is arranged on the first skin-contact fabric layer 111, this may make users feel uncomfortable about their skin. The reason is that the inelastic mesh features coarse texture and has certain pressure, which may cause discomfort to users. If the second pressure plate 17 is made of other materials, the second pressure plate 17 may lack breathability and may cause breast itching and allergies, or for some users, the pressure may be tight. Conversely, when the second pressure plate 17 is arranged on the first outer fabric layer 113 and separated by the cup pad 112, there may be less problems.

In this embodiment, the second pressure plate 17 extends to the second pressure portion 102 and covers the second pressure portion 102. The second pressure plate 17 is arranged near an outer side of the brassiere main body 100. The first pressure plate 16 is arranged near an inner side of the brassiere main body 100, and the second pressure plate 17 is configured for covering the first pressure plate 16. In this way, firstly, the pressure has a better transition effect. Secondly, since the brassiere main body 100 is covered by the outer fabric layer, the appearance of the cup 11 can be maintained. Because the second pressure plate 17 is separately arranged inside the cup 11, the connection between the cup 11 and an edge of the second pressure plate 17 is difficult to configure properly. Therefore, it may cause edge exposure or wrinkles, and the appearance may look not desirable. If the second pressure plate 17 extends to and covers the second pressure portion 102, there may be no such problem, thereby making the connection strength and adhesion of the second pressure plate better. Because the second pressure plate is designed as a thin layer, if only side edges are stitched, excessive pressure may easily cause damage. Conversely, if the second pressure plate 17 and the first pressure plate 16 are compacted together on the second pressure portion 102, it may not easily lead to damaged.

In this embodiment, the side wing 12 includes a second skin-contact fabric layer 121 and a second outer fabric layer 122. The second pressure plate 17 is arranged between the second skin-contact fabric layer 121 and the second outer fabric layer 122. The dual-layer arrangement of the side wing 12 can better mount the second pressure plate 17, and the second pressure plate 17 is arranged on the side wing 12 more stably.

In this embodiment, the support bone 15 includes a flexible bone 151 and an inelastic flexible padding sheet 152. A width of the inelastic flexible padding sheet 152 is greater than that of the flexible bone 151, and a length of the inelastic flexible padding sheet 152 is greater than that of the flexible bone 151. The flexible bone 151 is arranged on the inelastic flexible padding sheet 152. The inelastic flexible padding sheet 152 is arranged close to an inner side of the brassiere main body 100. The inner side of the brassiere main body 100 is a side close to the skin. In the existing technology, only one flexible bone 151 is arranged. Therefore, after the back wings 13 of the brassiere are interlocked, the flexible bone 151 may tightly press the skin. In addition, the width area of the flexible bone 151 is small. Therefore, the inelastic flexible padding sheet 152 is arranged to fit the skin surface, so as to play a role in dividing the pressure of the flexible bone 151. Compared with the condition that the skin is directly compressed by the flexible bone 151, users may feel more comfortable if the skin is in contact with the inelastic flexible padding sheet 152. Moreover, a first padding sheet can further divide the pressure of the inelastic flexible padding sheet 152. Therefore, this provides users with better wearing comfort, improves users'wearing experience, and solves the problem of being compressed when users wear the brassiere.

In this embodiment, the inelastic flexible padding sheet 152 further includes a connecting tab 1322. The flexible bone 151 is arranged between the inelastic flexible padding sheet 152 and the connecting tab 1322. The inelastic flexible padding sheet 152 is connected to the connecting tab 1322. It is preferred to use adhesive bonding according to the commonly used bonding method in the brassiere industry, or other bonding forms such as stitching. In this way, the flexible bone 151 is wrapped by the inelastic flexible padding sheet 152 and the connecting tab 1322. It should be noted that the inelastic flexible padding sheet 152 needs to have a certain thickness to achieve the effect of sharing pressure on the flexible bone 151. The specific thickness can be achieved by a fabric layer with a certain thickness or by combining multiple fabric layers. The requirement for thickness of the connecting tab 1322 is less strict. The connecting tab 1322 is arranged mainly to facilitate the encapsulation of the flexible bone 151, and to avoid obvious protrusion caused by direct contact between the flexible bone 151 and the outermost fabric layer of the brassiere main body 100. The thickness of the connecting tab 1322 can be in a range from one fifth to a half of the inelastic flexible padding sheet 152. By using the inelastic flexible padding sheet 152 and the connecting tab 1322, the connection between the flexible bone 151 and the inelastic flexible padding sheet 152 is facilitated, and the stability of the connection is improved.

In this embodiment, the inelastic flexible padding sheet 152 is configured for wrapped the flexible bone 151. Side edges of the inelastic flexible padding sheet 152 are thicker. Surfaces of the flexible bone 151 that are close to and opposite to the skin both are thinner than the side edges. That is, the inelastic flexible padding sheet 152 is flat-shaped, but not circular. If the flexible bone 151 is wrapped by a circular padding sheet, pressure distribution may not be achieved.

In this embodiment, an opening and a mounting space 133 are defined between the inelastic flexible padding sheet 152 and the connecting tab 1322. The flexible bone 151 is mounted inside the mounting space 133 via the opening. The opening is bonded after the flexible bone 151 is mounted inside the mounting space 133. This structure further facilitates the installation of the flexible bone 151, and the assembly process is simpler. Alternatively, place the flexible bone 151 between the inelastic flexible padding sheet 152 and the connecting tab 1322, and then bond the inelastic flexible padding sheet 152 and the connecting tab 1322 together. This assembly process may be complex. However, the specific assembling method among the inelastic flexible padding sheet 152, the connecting tab 1322, and the flexible bone 151 is not limited here. The opening is formed by bonding the periphery between the inelastic flexible padding sheet 152 and the connecting tab 1322. In addition, there is a gap on the opening for the flexible bone 151 to enter the mounting space 133.

In this embodiment, the back wing 122 includes a first fabric layer 1221 and a second fabric layer 1222. The support bone 15 is arranged between the first fabric layer 1221 and the second fabric layer 1222, so that the support bone 15 is wrapped by the first fabric layer 1221 and the second fabric layer 1222. Through arrangement of the above structure, the support bone 15 is wrapped by the first fabric layer 1221 and the second fabric layer 1222. Therefore, the support bone 15 is prevented from being exposed, and the overall aesthetic is increased.

In this embodiment, the connecting tab 1322 is bonded to the first fabric layer 1221 via an adhesive. Therefore, the connecting tab 1322 is bonded to the first fabric layer 1221 in a flatter manner, so that the brassiere looks more aesthetic.

In this embodiment, the inelastic flexible padding sheet 152 is bonded to the second fabric layer 1222 by using an adhesive dispensing method. This method provides a stable connection and has less strict requirement for aesthetic. Therefore, in addition to the adhesive dispensing method, other stable bonding methods may also be employed, so long as the connection is flat and stable. In contrast, if the inelastic flexible padding sheet 152 is attached to the inner fabric layer 101 via an adhesive. The low adhesion of the adhesive may result in insufficient stabilization of the support bone 15, which may cause the support bone 15 to detach easily.

In this embodiment, a thickness of the inelastic flexible padding sheet 152 is greater than that of the connecting tab 1322. The connecting tab 1322 is arranged close to an outer side surface of the brassiere main body 100. The inelastic flexible padding sheet 152 is arranged close to an inner side surface of the brassiere main body 100. Because the inelastic flexible padding sheet 152 is closer to the skin, the padding sheet needs to be softer and have a certain thickness. The function of the connecting tab 1322 is to wrap the flexible bone 151 with the inelastic flexible padding sheet 152, and to connect to the outer fabric layer of the side wing 12. Therefore, the connecting tab 1322 is not thick and should be designed as light and thin as possible, so as to make the appearance of the brassiere more aesthetic. However, if the connecting tab 1322 is too thick, the appearance of the brassiere will appear less aesthetic, thereby affecting users'purchasing desire. Of course, there is no clear boundary of the relative thickness between the inelastic flexible padding sheet 152 and the connecting tab 1322. It is only necessary to ensure that the inelastic flexible padding sheet 152 has a certain thickness to share the pressure on the flexible bone 151.

In this embodiment, the support bone 15 is configured as a flat strap. An upper end and an opposite lower end both are designed as outwardly flared arcs. This shape enhances comfort. If the overall support bone 15 is designed as a simple flat rectangle with corners, this shape may easily hurt user' skin during movement. Therefore, the contour of the support bone 15 should be designed to be smooth. That is, the upper end and the opposite lower end of the support bone 15 are both designed as outwardly flared arcs.

In this embodiment, eyes 21 and hooks 22 are respectively arranged on end portions of the two back wings 13. The eyes 21 are detachably connected to the hooks 22, so that the two back wings 13 are detachably connected. Therefore, this facilitates users to put on and take off the brassiere.

In this embodiment, the brassiere main body 100 further includes shoulder straps 7. Two ends of the shoulder straps 7 are connected to the brassiere main body 100. Users can wear the brassiere on their bodies through the shoulder straps 7.

In summary, the brassiere in this embodiment can achieve a good effect of gathering mamma accessoria through the structure of three-stage pressure distribution. This greatly improves users' wearing comfort and enhances users' wearing experience. At the same time, it can achieve an uplifted breast shaping effect while providing wearing comfort.

Second Embodiment

Figure 11:
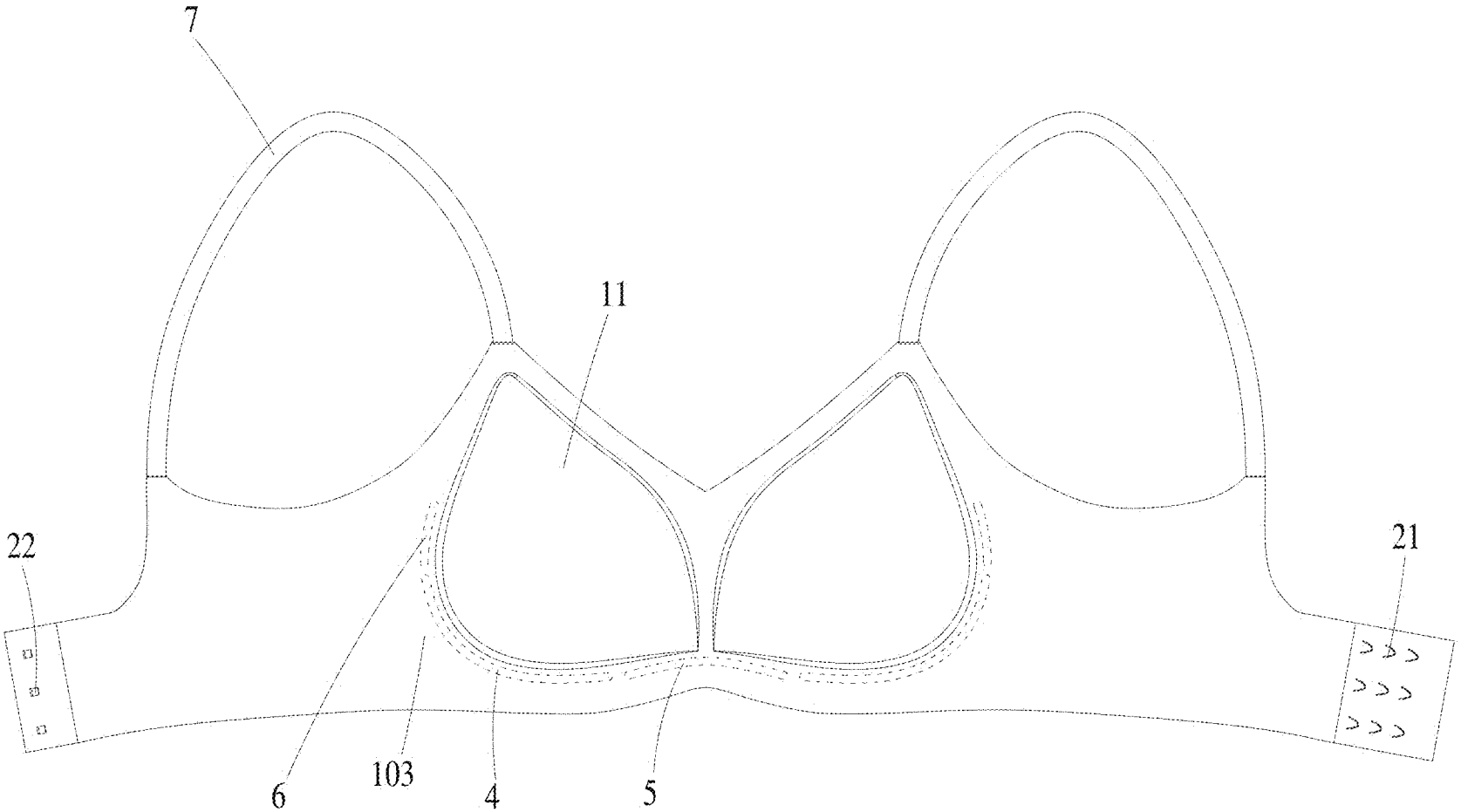
FIG. 11 is a perspective view of the brassiere in the second embodiment of the disclosure.
Figure 12:
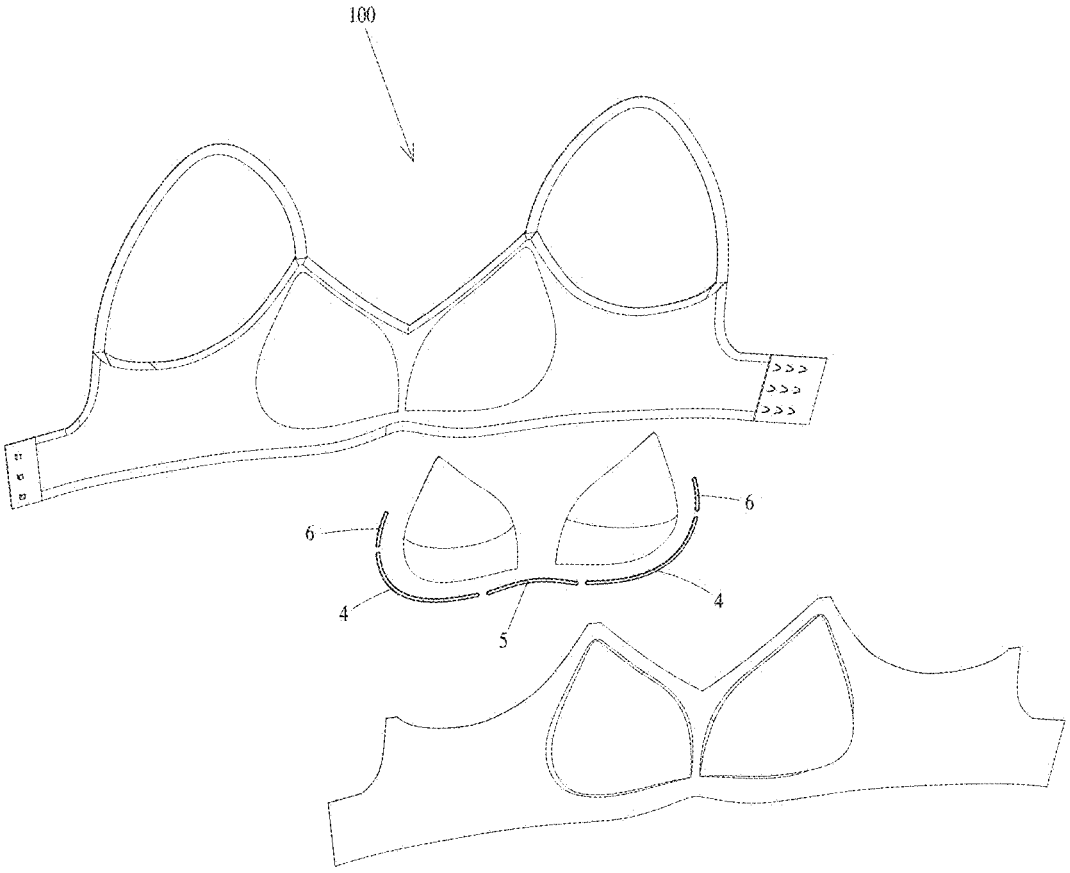
FIG. 12 is an exploded view of the brassiere in the second embodiment of the disclosure.

Referring to FIG. 11-FIG. 12, compared with the first embodiment, the brassiere main body 100 further includes a first support bone 4, a second support bone 5, and a third support bone 6. The first support bone 4 is subjected to a greater bearing pressure than the second support bone 5, and the second support bone 5 is subjected to a greater bearing pressure than the third support bone 6. The first support bone 4, the second support bone 5, and the third support bone 6 are arranged on the second pressure portion 102. The first support bone 4, the second support bone 5, and the third support bone 6 are arranged adjacently along an edge of the cup 11. The first support bone 4 is arranged between the second support bone 5 and the third support bone 6. The third support bone 6 is arranged on the side wing 12. A first portion of the first support bone 4 extends to a connecting edge between the side wing 12 and the cup 11, and a second portion of the first support bone 4 is arranged on the lower band 14. The second support bone 5 is arranged on the lower band 14 and is adjacent to lower edges of two cups 11. Through arrangement of the above structure, the first support bone 4 has the highest bearing pressure, and can support an area of the breast that is most affected by gravity. The second support bone 5 can provide support for a lower portion of the breast, and the third support bone 6 can provide support for a lateral side of the breast. The first support bone 4, the second support bone 5, and the third support bone 6 are configured for cooperating together to support the area of the breast that is most affected by gravity, and the lower portion and the lateral side of the breast, so as to avoid breast sagging. In this segmented design, support bones with various support functions are designed at different positions, which provides users with wearing comfort and a better breast shaping effect.

In this embodiment, the first support bone 4 is a flexible polymeric support bone of a first thickness, the second support bone 5 is a flexible polymeric support bone of a second thickness, and the third support bone 6 is a flexible polymeric support bone of a third thickness. The flexible polymeric support bone of a first thickness has a good load-bearing capacity, and the flexible polymeric support bone of a second thickness has a moderate load-bearing capacity. The flexible polymeric support bone of a third thickness has minimal support. These three different materials can provide different supporting force for varying regions of the breast. In addition, the support bone can also achieve supporting force through width differences. When the thickness of the support bones is the same, the width of the first support bone 4 is designed to be the largest, which can provide the largest supporting force. The width of the second support bone 5 is designed to be smaller, which can provide a lower supporting force. The width of the third support bone 6 is designed to be the smallest, which can provide minimal support. The first support bone 4, the second support bone 5, and the third support bone 6 are all made of flexible polymeric support bone. Compared with the steel ring, the flexible polymeric support bone material is softer and more elastic, which can better adapt to the breast shape and reduce wearing discomfort. The flexible polymeric support bone can provide better comfort especially in the case of long-term wear. The flexible polymeric support bone material has good plasticity and can be adjusted to a certain extent according to the needs of different users. The flexible polymeric support bone material can resist daily wear and maintain good elasticity and shape even after long-term use.

In this embodiment, the first support bone 4, the second support bone 5, and the third support bone 6 are all flat-shaped. This increases the force area and reduces the pressure on the skin. Therefore, the design that the first support bone 4, the second support bone 5, and the third support bone 6 are all flat-shaped further improves users'wearing comfort.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A brassiere configured for gathering mamma accessoria, the brassiere comprising a brassiere main body, the brassiere main body comprising a first pressure portion, a second pressure portion, and a third pressure portion, the brassiere main body further comprising a cup, a side wing, and a back wing, wherein an outer side edge of the cup is connected to a first side of the side wing, a second side of the side wing is connected to the back wing, the first pressure portion is arranged at a junction between the side wing and the back wing, the junction is positioned on the back wing, the first pressure portion is configured for providing pressure to a lateral side of the brassiere main body, a first portion of the second pressure portion is arranged on the side wing, the second pressure portion is configured for providing pressure to the lateral side of the brassiere main body, the third pressure portion is arranged on the cup and close to the side wing, and the third pressure portion is configured for providing pressure to the cup;

wherein the brassiere main body further comprises a lower band, the lower band is arranged below the cup and is connected to the cup, the lower band is connected to the side wing, the brassiere main body further comprises a first support bone, a second support bone, and a third support bone, the first support bone is subjected to a greater bearing pressure than the second support bone, and the second support bone is subjected to a greater bearing pressure than the third support bone; the first support bone, the second support bone, and the third support bone are arranged adjacently along an edge of the cup, the first support bone is arranged between the second support bone and the third support bone, the third support bone is arranged at a connecting edge between the side wing and the cup, a first portion of the first support bone extends to the connecting edge between the side wing and the cup, a second portion of the first support bone is arranged on the lower band, and the second support bone is arranged on the lower band and is adjacent to lower edges of two cups;

wherein the first support bone, the second support bone, and the third support bone are all flat-shaped; the first support bone is a flexible polymeric support bone of a first thickness, the second support bone is a flexible polymeric support bone of a second thickness, and the third support bone is a flexible polymeric support bone of a third thickness; the first thickness is larger than the second thickness, and the second thickness is larger than the third thickness; eyes and hooks are respectively arranged on end portions of two back wings, and the eyes are detachably connected to the hooks, so that the two back wings are detachably connected.

2. The brassiere according to claim 1, wherein pressure provided by the first pressure portion is greater than pressure provided by the second pressure portion, and the pressure provided by the second pressure portion is greater than pressure provided by the third pressure portion.

3. The brassiere according to claim 1, wherein the brassiere main body further comprises a lower band, the lower band is arranged below the cup and is connected to the cup, the lower band is connected to the side wing, and a second portion of the second pressure portion is arranged on the lower band and is configured for providing pressure to a lower portion of the brassiere main body.

4. The brassiere according to claim 3, wherein the second pressure portion is configured for fully covering the side wing longitudinally along a boundary of the first pressure portion adjacent to the side wing, and the second pressure portion is configured for fully covering the lower band, so as to enable the second pressure portion to provide pressure to the lateral side and the lower portion of the brassiere main body.

5. The brassiere according to claim 3, wherein the second pressure portion on the lower band and the second pressure portion on the side wing are connected to form a W-shape, so as to enable the second pressure portion to provide pressure to the lateral side and the lower portion of the brassiere main body, and to provide a supporting force to the lower portion of the brassiere main body.

6. The brassiere according to claim 3, wherein the second pressure portion is configured for fully covering the side wing longitudinally along a boundary of the first pressure portion adjacent to the side wing, and the second pressure portion is configured for fully covering the lower band, so as to enable the second pressure portion to provide pressure to the lateral side and the lower portion of the brassiere main body.

7. The brassiere according to claim 1, wherein the brassiere main body further comprises a lower band, the lower band is arranged below the cup and is connected to the cup, the lower band is connected to the side wing, one side of the third pressure portion is at least connected to side edges of the cup close to the side wing and the lower band, so as to enable the third pressure portion to provide pressure to the cup both at a lateral side and a lower portion.

8. The brassiere according to claim 1, wherein an inner edge of the third pressure portion close to a central area of the cup is in a released state, and the inner edge is arc-shaped, so as to enable the inner edge to match a shape of the cup, so that the third pressure portion is configured for providing no pressure to the central area of the cup.

9. The brassiere according to claim 1, wherein a top end of the third pressure portion is arranged at a vertex of a front panel edge of the cup, a bottom end of the third pressure portion is arranged close to a lowest point of a lower support of the cup, a boundary of the third pressure portion distal from the side wing is arranged close to a central line of the cup, so that the third pressure portion is enabled to provide pressure to an area between the vertex of the cup and the lowest point of the cup.

10. The brassiere according to claim 1, wherein the first pressure portion, the second pressure portion, and the third pressure portion are made of different materials, so that the first pressure region, the second pressure region, and the third pressure region are enabled to provide different pressure.

11. A brassiere configured for gathering mamma accessoria, the brassiere comprising a brassiere main body, the brassiere main body further comprising a cup, a side wing, and a back wing, wherein an outer side edge of the cup is connected to a first side of the side wing, a second side of the side wing is connected to the back wing;

wherein the brassiere main body further comprises a lower band, the lower band is arranged below the cup and is connected to the cup, the lower band is connected to the side wing, the brassiere main body further comprises a first support bone, a second support bone, and a third support bone, the first support bone is subjected to a greater bearing pressure than the second support bone, and the second support bone is subjected to a greater bearing pressure than the third support bone; the first support bone, the second support bone, and the third support bone are arranged adjacently along an edge of the cup, the first support bone is arranged between the second support bone and the third support bone, the third support bone is arranged at a connecting edge between the side wing and the cup, a first portion of the first support bone extends to the connecting edge between the side wing and the cup, a second portion of the first support bone is arranged on the lower band, and the second support bone is arranged on the lower band and is adjacent to lower edges of two cups;

wherein the first support bone, the second support bone, and the third support bone are all flat-shaped; the first support bone is a flexible polymeric support bone of a first thickness, the second support bone is a flexible polymeric support bone of a second thickness, and the third support bone is a flexible polymeric support bone of a third thickness; the first thickness is larger than the second thickness, and the second thickness is larger than the third thickness.

12. The brassiere according to claim 11, wherein pressure provided by the first pressure portion is greater than pressure provided by the second pressure portion, and the pressure provided by the second pressure portion is greater than pressure provided by the third pressure portion.

13. The brassiere according to claim 11, wherein the brassiere main body further comprises a lower band, the lower band is arranged below the cup and is connected to the cup, the lower band is connected to the side wing, and a second portion of the second pressure portion is arranged on the lower band and is configured for providing pressure to a lower portion of the brassiere main body.

14. The brassiere according to claim 13, wherein the second pressure portion on the lower band and the second pressure portion on the side wing are connected to form a W-shape, so as to enable the second pressure portion to provide pressure to the lateral side and the lower portion of the brassiere main body, and to provide a supporting force to the lower portion of the brassiere main body.

15. The brassiere according to claim 11, wherein the brassiere main body further comprises a lower band, the lower band is arranged below the cup and is connected to the cup, the lower band is connected to the side wing, one side of the third pressure portion is at least connected to side edges of the cup close to the side wing and the lower band, so as to enable the third pressure portion to provide pressure to the cup both at a lateral side and a lower portion.

16. The brassiere according to claim 11, wherein an inner edge of the third pressure portion close to a central area of the cup is in a released state, and the inner edge is arc-shaped, so as to enable the inner edge to match a shape of the cup, so that the third pressure portion is configured for providing no pressure to the central area of the cup.

17. The brassiere according to claim 11, wherein a top end of the third pressure portion is arranged at a vertex of a front panel edge of the cup, a bottom end of the third pressure portion is arranged close to a lowest point of a lower support of the cup, a boundary of the third pressure portion distal from the side wing is arranged close to a central line of the cup, so that the third pressure portion is enabled to provide pressure to an area between the vertex of the cup and the lowest point of the cup.

18. The brassiere according to claim 11, wherein the first pressure portion, the second pressure portion, and the third pressure portion are made of different materials, so that the first pressure region, the second pressure region, and the third pressure region are enabled to provide different pressure.

* * * * *